US006151052A

United States Patent [19]

Yang et al.

[11] Patent Number: 6,151,052

[45] Date of Patent: Nov. 21, 2000

[54] INK JET CARTRIDGE FOR AN INK JET PRINTING APPARATUS

[75] Inventors: Arnold Chang-mou Yang; Ji-chen Wu; Wen-kang Sung; Ming-hsun Yang, all of Hsinchu, Taiwan

[73] Assignee: Wisertek International Corporation, Hsinchu, Taiwan

[21] Appl. No.: 09/465,001

[22] Filed: Dec. 16, 1999

[30] Foreign Application Priority Data

Aug. 6, 1999 [TW] Taiwan ..... 88213457

[51] Int. Cl.[7] ..... B41J 2/175

[52] U.S. Cl. ..... 347/87

[58] Field of Search ..... 347/85, 86, 87, 347/84

[56] References Cited

U.S. PATENT DOCUMENTS 5,505,339 4/1996 Cowger et al. ..... 222/105
5,537,134 7/1996 Baldwin et al. ..... 347/85
5,872,584 2/1999 Hauck et al. ..... 347/86
5,917,523 6/1999 Baldwin et al. ..... 347/85
5,975,686 11/1999 Hauck et al. ..... 347/85
5,988,803 11/1999 Komplin et al. ..... 347/86

*Primary Examiner*—N. Le
*Assistant Examiner*—Judy Nguyen

[57] ABSTRACT

The ink-jet cartridge of the present invention includes two magnetic plates attached to the two sides of a flexible ink reservoir and facing each other with their sides of the same magnetic polarity. Alternatively, the two magnetic plates are attached to two flexible bags within the rigid ink reservoir and face each other with their sides of the same magnetic polarity. Due to the repulsive force generated by the two magnetic plates, a pressure regulating effect can be achieved within the ink reservoir to prevent ink leakage and provide smooth ink delivery while printing.

3 Claims, 2 Drawing Sheets

INK JET CARTRIDGE FOR AN INK JET PRINTING APPARATUS

FIELD OF THE INVENTION

The present invention relates to an ink-jet cartridge for an ink-jet printing apparatus, and more particularly, to an ink-jet cartridge having a pressure regulator for regulating the pressure within the ink reservoir to provide smooth ink delivery and prevent ink leakage during ink-jet printing.

BACKGROUND OF THE INVENTION

An ink-jet cartridge structure for a conventional ink-jet printing apparatus, as disclosed in U.S. Pat. No. 5,409,134, provides a fluid pressure regulator in the ink reservoir for controlling the back pressure within an operating range that is suitable for preventing ink leakage while permitting the ejecting element to eject ink drops during printing. As shown in this prior patent, the fluid pressure regulation in the rigid ink reservoir can be controlled by a flexible bag that is mounted to a curved spring. The pressure within the rigid ink reservoir drops instantly as the ink is ejected from the rigid ink reservoir via the ejecting element. At this moment, the ambient pressure is larger than the pressure within the rigid ink reservoir. Thus, ambient air will flow into the flexible bag so that the ink can be ejected smoothly while printing. Moreover, the expansion of the bag causes the deflection of the adjacent springs and thus decreases the ink pressure in the ink reservoir so that ink leakage can be prevented during printing.

SUMMARY OF THE INVENTION

An object of the present invention is to provide an ink-jet cartridge for an ink-jet printing apparatus so that when the ink is ejected from the ink reservoir for printing, a negative pressure is generated in the ink reservoir to achieve the effect of preventing ink leakage.

Another object of the present invention is to provide an ink-jet cartridge for an ink-jet printing apparatus so that when the ink is ejected from the ink reservoir for printing, the ink can be delivered continuously from the ink reservoir to achieve the effect of smooth ink delivery.

To achieve the above objects, the ink-jet cartridge in accordance with a preferred embodiment of the invention includes two magnetic plates disposed on the two sides of a flexible ink reservoir and facing each other with their sides of the same magnetic polarity. For another embodiment, the two magnetic plates are secured onto the two flexible bags within the rigid ink reservoir and facing to each other with the side of the same magnetism. Due to the repulsive force generated by the two magnetic plates, a negative pressure is kept within the rigid ink reservoir to prevent ink leakage and provide smooth ink delivery while printing.

That is, the back pressure within the flexible ink reservoir decreases as the ink is ejected from the ink reservoir for printing. At this moment, the ambient air pressure pushes the membranes of the flexible ink reservoir towards each other. However, the two magnetic plates repel each other as they are pushed to get closer to each other. Thus, the negative pressure increases due to the distance between the two magnetic plates determined by the repulsive force. In the other preferred embodiment of the present invention, the flexible bags are disposed in the rigid ink reservoir for pressure regulation. The pressure within the ink reservoir decreases as the ink is ejected from the ink reservoir. At this moment, the ambient air inflates the flexible bags. It causes the two magnetic plates attached on the flexible bags to move towards each other. Due to the repulsive force, a distance is kept between the two magnetic plates and thus the negative pressure increases. With the pressure regulator, the ink-jet cartridge provides smooth ink delivery while preventing ink leakage during printing.

BRIEF DESCRIPTION OF THE DRAWINGS

These and other objects and advantages of the present invention will become apparent by reference to the following description and accompanying drawings wherein.

DETAILED DESCRIPTION OF THE PREFERRED EMBODIMENT

Figure 1:
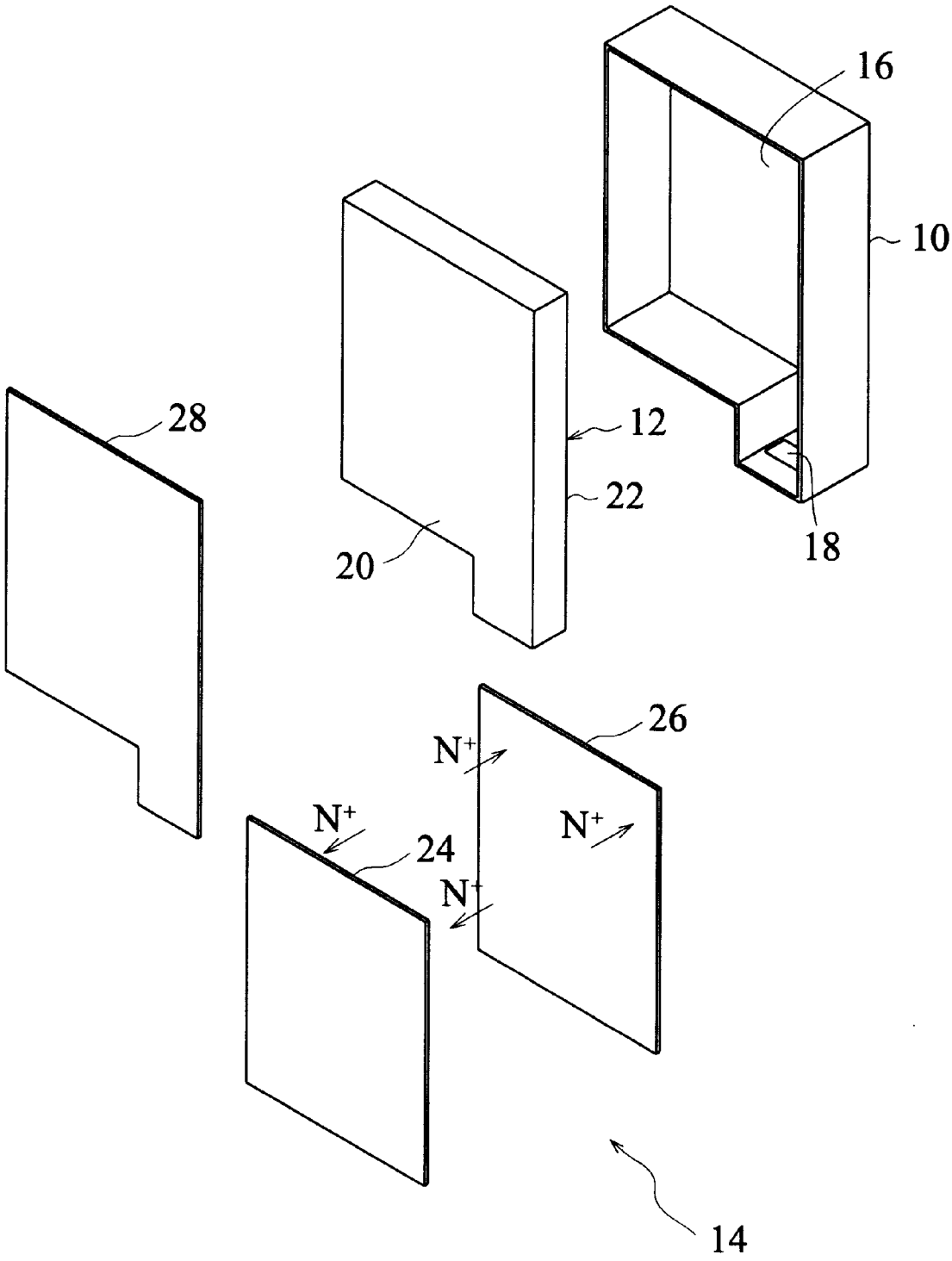
FIG. 1 is an exploded view showing an ink-jet cartridge in accordance with a preferred embodiment of the invention.
Figure 2:
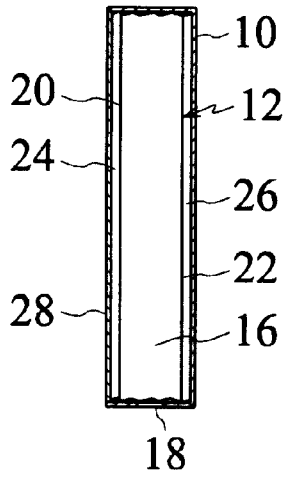
FIG. 2 is a side view showing the ink-jet cartridge.

Referring to FIGS. 1 and 2, the ink-jet cartridge for an ink-jet printing apparatus in accordance with a preferred embodiment of the invention includes a rigid body 10, a flexible ink reservoir 12, and a pressure regulator 14.

The rigid body 10 is formed with a cavity 16 for accommodating the flexible ink reservoir 12, and an ejecting device 18 provided at one end of the rigid body 10 for ejecting the ink from the flexible ink reservoir 12.

The flexible ink reservoir 12 is mounted within the cavity 16 of the rigid body 10 and connected to the ejecting device 18 for ink reservoir. The ejecting device 18 ejects the ink from the flexible ink reservoir 12. The flexible ink reservoir 12 has two pieces of mutually movable membranes 20, 22 that move to each other as the ink is ejected from the flexible ink reservoir 12.

The pressure regulator 14 consists of two magnetic plates 24 and 26. The two magnetic plates 24 and 26 are attached onto the membranes 20, 22 of the flexible ink reservoir 12 respectively. The two magnetic plates 24 and 26 face each other with their sides of N polarity so as to repel each other. A cover plate 28 covers the rigid body 10 and secures the flexible ink reservoir 12 within the rigid body 10.

When printing, the pressure within the flexible ink reservoir 12 drops as the ink is ejected from the flexible ink reservoir 12 via the ejecting device 18. Due to the pressure change within the flexible ink reservoir 12, the two membranes 20 and 22 are pushed towards each other by the ambient air pressure. However, due to the repulsive force between the two magnetic plates 24 and 26, a negative pressure is created within the flexible ink reservoir 12. The negative pressure within the flexible ink reservoir 12 prevents ink leakage during printing. When the two membranes 20, 22 are pushed towards each other by the ambient air pressure, a proper pressure is provided within the flexible ink reservoir 12 to provide smooth ink delivery while printing.

Accordingly, regulating the magnitude of the magnetism of the two magnetic plates 24 and 26 changes the forces pushing the two membranes 20, 22 and thus the effects of smooth ink delivery and zero ink leakage while printing can be achieved.

Figure 3:
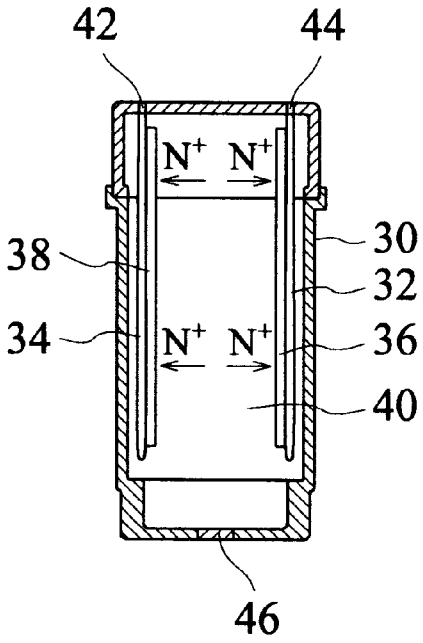
FIG. 3 is a sectional view showing an ink-jet cartridge in accordance with another preferred embodiment of the invention.
Figure 4:
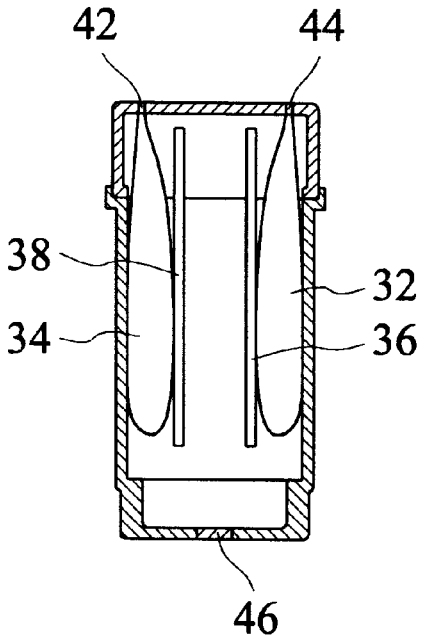
FIG. 4 is a sectional view showing the ink-jet cartridge, as shown in FIG. 3, wherein two flexible bags are inflated.

Referring to FIGS. 3 and 4, the ink-jet cartridge for an ink-jet printing apparatus in accordance with another preferred embodiment of the present invention includes a rigid body 30, two flexible bags 32 and 34 and two magnetic plates 36 and 38.

The rigid body 30 has an ink reservoir 40 for holding ink. Two air inlet orifices 42 and 44 are formed on a side wall of the rigid body 30. An ejecting device 46 is mounted on the bottom end of the rigid body 30 for ejecting ink from the ink reservoir 40.

Two flexible bags 32 and 34 are mounted within the ink reservoir 40 of the rigid body 30 and allow the ambient air to flow into the flexible bags 32 and 34 via the air inlet orifices 42 and 44 respectively.

The magnetic plates 36 and 38 are attached onto the flexible bags 32 and 34 respectively in a manner that the magnetic plates 36 and 38 face each other with their sides of N polarity so as to repel each other.

Thus, the pressure within the ink reservoir 40 of the rigid body 30 decreases as the ink of the ink reservoir 40 is ejected via the ejecting device 46. At this moment, the ambient air flows into the flexible bags 32 and 34 via air inlet orifices 42 and 44 respectively and inflates the flexible bags 32 and 34. Therefore, the pressure within the ink reservoir 40 is kept at a proper value and the ink-jet cartridge in accordance with the embodiment of the present allows the ink-jet printer to smoothly supply ink while printing.

On the other hand, when the two flexible bags 32, 34 are getting closer to each other due to the inflation caused by ink consumption, the repulsive force between the two magnetic plates 36, 38 keeps a distance between the two magnetic plates 36, 38 and keeps a proper negative pressure within the ink reservoir 40 to prevent ink leakage from the ejecting device 46. Thus, controlling the magnitude of the repulsive force between the two magnetic plates 36, 38 can provide smooth ink supply and prevent ink leakage while printing.

While the invention has been described by way of example and in terms of the preferred embodiments, it is to be understood that the invention is not limited to the disclosed embodiments. To the contrary, it is intended to cover various modifications. Therefore, the scope of the appended claims should be accorded the broadest interpretation so as to encompass all such modifications.

What is claimed is:

1. An ink-jet cartridge for an ink jet printing apparatus, comprising:

a rigid body for holding ink and provided with an ejecting device for ejecting ink;

two flexible bags disposed within said rigid body, each of the two flexible bags having an air inlet orifice for communication with the ambient air; and pressure regulator having two magnetic plates, the two magnetic plates being attached to said two flexible bags respectively and facing each other with their sides of the same magnetic polarity to generate a repulsive force.

2. The ink-jet cartridge according to claim 1, wherein said two magnetic plates face each other with their sides of N polarity to generate a repulsive force.

3. The ink-jet cartridge according to claim 1, wherein said two flexible bags can be inflated to occupy the entire space within said rigid body.

* * * * *